US008291708B2

(12) United States Patent
Lee et al.

(10) Patent No.: US 8,291,708 B2
(45) Date of Patent: Oct. 23, 2012

(54) COMBUSTOR AND MULTI COMBUSTOR INCLUDING THE COMBUSTOR, AND COMBUSTING METHOD

(75) Inventors: Min-Chul Lee, Daejeon (KR); Jae-Hwa Chung, Daejeon (KR); Seok-Bin Seo, Daejeon (KR); Yong-Jin Joo, Daejeon (KR); Jong-Jin Kim, Daejeon (KP); Dal-Hong Ahn, Daejeon (KR)

(73) Assignee: Korea Electric Power Corporation, Seoul (KR)

( * ) Notice: Subject to any disclaimer, the term of this patent is extended or adjusted under 35 U.S.C. 154(b) by 1117 days.

(21) Appl. No.: 11/928,522

(22) Filed: Oct. 30, 2007

(65) Prior Publication Data

US 2008/0098736 A1 May 1, 2008

(30) Foreign Application Priority Data

Oct. 31, 2006 (KR) ..... 10-2006-0106423

(51) Int. Cl.
*F02C 1/00* (2006.01)
*F02G 3/00* (2006.01)

(52) U.S. Cl. ..... 60/748; 60/741; 60/737

(58) Field of Classification Search ..... 60/741, 60/734, 740, 748, 737, 752, 39.39, 39.78; 239/407–417.5; 431/11, 60, 278, 279, 280, 431/281, 284, 285

See application file for complete search history.

(56) References Cited

U.S. PATENT DOCUMENTS

| | | | | |
|---|---|---|---|---|
| 3,462,950 | A * | 8/1969 | Chevalaz | 60/258 |
| 3,991,561 | A | 11/1976 | Leto | |
| 5,066,221 | A * | 11/1991 | Becker | 431/280 |
| 6,094,916 | A * | 8/2000 | Puri et al. | 60/737 |
| 6,123,273 | A | 9/2000 | Loprinzo et al. | |
| 6,394,789 | B1 * | 5/2002 | Yabuuchi et al. | 431/7 |
| 6,928,823 | B2 * | 8/2005 | Inoue et al. | 60/776 |
| 7,654,090 | B2 * | 2/2010 | Blomeyer | 60/748 |

* cited by examiner

*Primary Examiner* — William H Rodriguez
*Assistant Examiner* — Carlos A Rivera
(74) *Attorney, Agent, or Firm* — McDermott Will & Emery LLP

(57) ABSTRACT

A dual fuel nozzle of a gas turbine combustor with a variable jetting hole diameter is disclosed. The combustor includes a plurality of swirling wings disposed along an outer peripheral surface of a central shaft to have at least one main fuel jetting hole, an air duct positioned at the lower side of the swirling wings to supply air to the swirling wings, a pilot fuel injection hole and jetting hole formed to pass through a central portion of the central shaft to supply a pilot fuel, a switching plate disposed inside the swirling wings to vary the size of the main fuel jetting hole, a driving unit disposed to be connected to the switching plate to move a position of the switching plate, and a casing containing the swirling wings, the air duct, the switching plate and the driving unit. It is possible to enhance fuel flexibility in a multiple fuel system for applying two or more fuels to a gas turbine at the same time.

9 Claims, 5 Drawing Sheets

COMBUSTOR AND MULTI COMBUSTOR INCLUDING THE COMBUSTOR, AND COMBUSTING METHOD

BACKGROUND OF THE INVENTION

1. Field of the Invention

The present invention relates to a dual fuel nozzle of a gas turbine combustor with a variable jetting hole diameter, and more particularly to a dual fuel nozzle of a gas turbine combustor with a variable jetting hole diameter capable of enhancing fuel flexibility in a multiple fuel system for applying two or more fuels to a gas turbine at the same time.

2. Description of the Related Art

Recently, development of various clean fuels has been conducted in many research institutions of the world to solve an emission problem of an energy source and an environmental problem. Many fuels such as biomass, a coal gas, GTL (Gas To Liquid Fuel) and CTL (Coal To Liquid Fuel) have been developed and commercialized recently. Also, the research and development have been conducted in a consumption field with the manufacture of the fuels.

A dry low NOx gas turbine employs a lean premixed combustion method, wherein a local high-temperature region in the diffusive flame is not generated, thereby suppressing the production of thermal NOx.

However, in the lean premixed combustion method, a mass ratio of a fuel amount to an air amount is 10% or less. It means that the control of the fuel amount is very important. Further, it is very difficult to reach stable combustion conditions of the lean premixed flame. Accordingly, combustion instability, combustion vibration, a backfire of the flame and the like are generated according to a mixing state of fuel and air and load conditions. Thus, there are problems such as damage of gas turbine parts due to abnormal combustion and large pressure variation or heat loss of parts and life reduction due to high-temperature flow (hot gas), thereby causing an increase in the maintenance and repair costs of a gas turbine.

Further, conventionally, when the gas turbine is operated at a low load, a noxious gas such as yellow plume caused by $NO_2$ is discharged according to a combustion state. Thus, it may incur the enmity of the people around a power plant.

Recently, in the power plant using the gas turbine, a natural gas in which methane ($CH_4$) has a volume ratio of 85% or more or distillate oil serving as a back-up fuel is used as a fuel. However, the fuel has a large range of fluctuation in market prices and a gas turbine capable of applying various power generation fuels thereto should be developed to correspond to the fluctuation range. Particularly, in the future, DME (dimethyl ether, $CH_3OCH_3$) which is a new fuel manufactured through a chemical processing method from various fuels such as a natural gas, coal, biomass and the like is expected to be applied after evaluating economical efficiency and technical efficiency. The DME has combustion characteristics such as a high burning velocity and a low ignition temperature. When the fuel is applied to the gas turbine power plant, the combustor may be burnt out due to the backfire of the flame. Also, a low heating value of the DME, 28.8 MJ/kg (59.3 MJ/Nm$^3$), is lower than a low heating value of a natural gas, which is 49.0 MJ/kg (35.9 MJ/Nm$^3$). Accordingly, it requires retrofitting of the combustor. Further, the combustor should be retrofitted to selectively use the natural gas and the DME fuel.

A dual fuel type gas turbine using heavy oil and natural gas, which is recently used for power generation, has independent channels which jet the fuel through different fuel jetting holes.

However, in the case of heavy oil power generation, the power generation cost is expensive and a noxious exhaust gas is largely generated. Accordingly, it is excluded from priority of power generation and the power generation is performed mainly using a natural gas as a fuel.

SUMMARY OF THE INVENTION

Therefore, the present invention has been made in view of the above problems, and it is an object of the present invention to provide a multi fuel nozzle of a gas turbine combustor with a variable jetting hole diameter capable of enhancing fuel flexibility in a multiple fuel system for applying two or more fuels to a gas turbine at the same time.

In accordance with an aspect of the present invention, there is provided a dual fuel nozzle of a gas turbine combustor with a variable jetting hole diameter, which includes a plurality of swirling wings disposed along an outer peripheral surface of a central shaft to have at least one main fuel jetting hole; an air duct positioned at the lower side of the swirling wings to supply air to the swirling wings; a pilot fuel injection hole and jetting hole formed to pass through a central portion of the central shaft to supply a pilot fuel; a switching plate disposed inside the swirling wings to vary the size of the main fuel jetting hole; a driving unit disposed to be connected to the switching plate to move a position of the switching plate; and a casing containing the swirling wings, the air duct, the switching plate and the driving unit.

Further, the main fuel jetting hole is formed in a direction of the central shaft to have a smaller diameter as it goes toward the central shaft. At least one switching hole is formed on the switching plate, and the switching hole has a smaller diameter as it goes toward the central shaft.

The switching holes include first switching holes and second switching holes. Preferably, the first switching holes and the second switching holes are arranged to have different diameters.

Further, the driving unit includes a rack gear, a spur gear which horizontally moves the rack gear, and a wire which connects the rack gear and the switching plate to vary the position of the switching plate. The main fuel jetting hole has a variable diameter according to a supplied fuel. Any one selected from a group consisting of a natural gas, DME (dimethyl ether, $CH_3OCH_3$), a coal gas and a synthetic gas may be supplied as the varied diameter.

Further, there is also provided a liner with at least one plurality of variable dual fuel nozzle.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Figure 1:
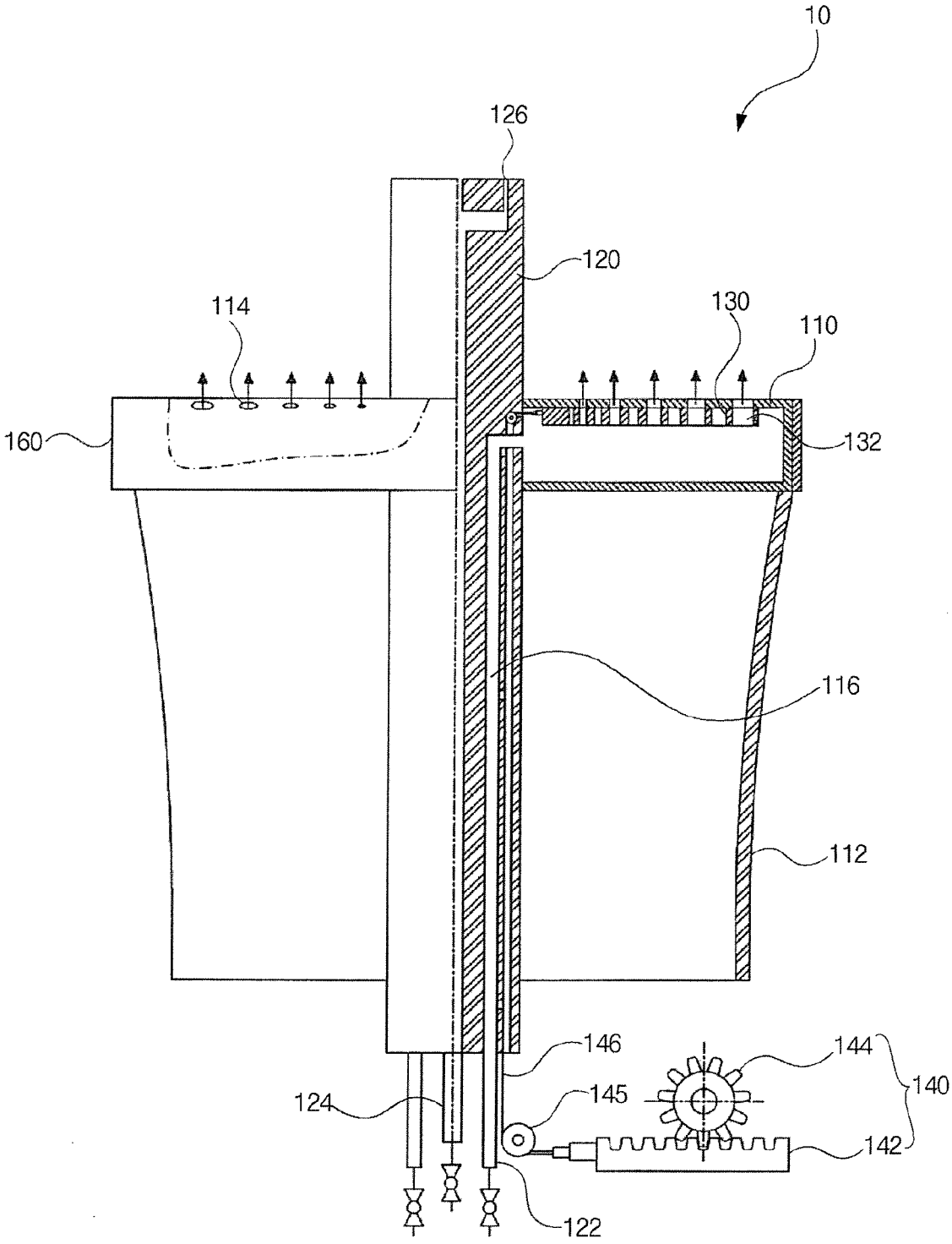
FIG. 1 illustrates a cross-sectional view of a variable dual fuel nozzle according to the present invention.
Figure 2:
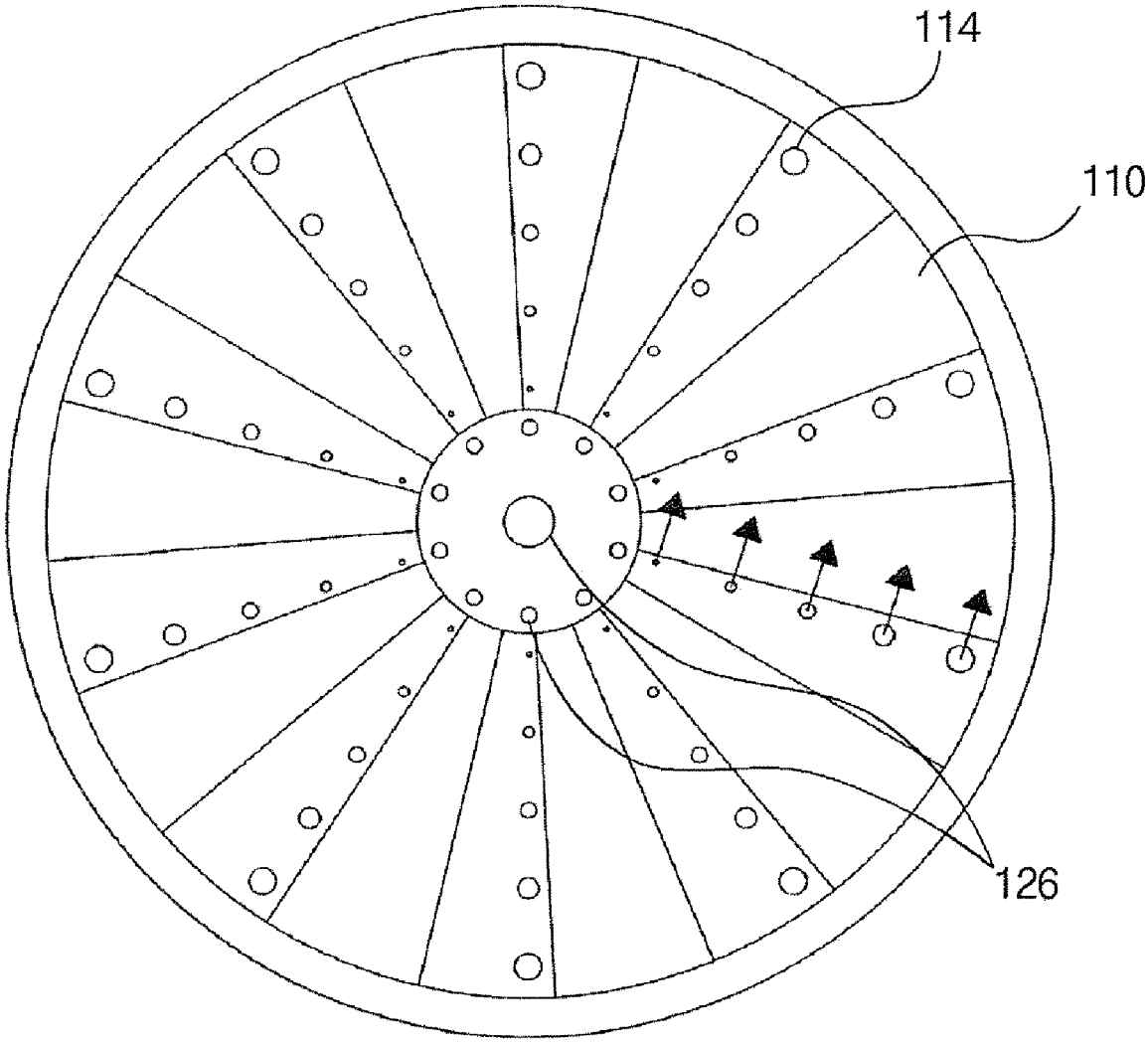
FIG. 2 illustrates a plan view of the variable dual fuel nozzle shown in FIG. 1.
Figure 3:
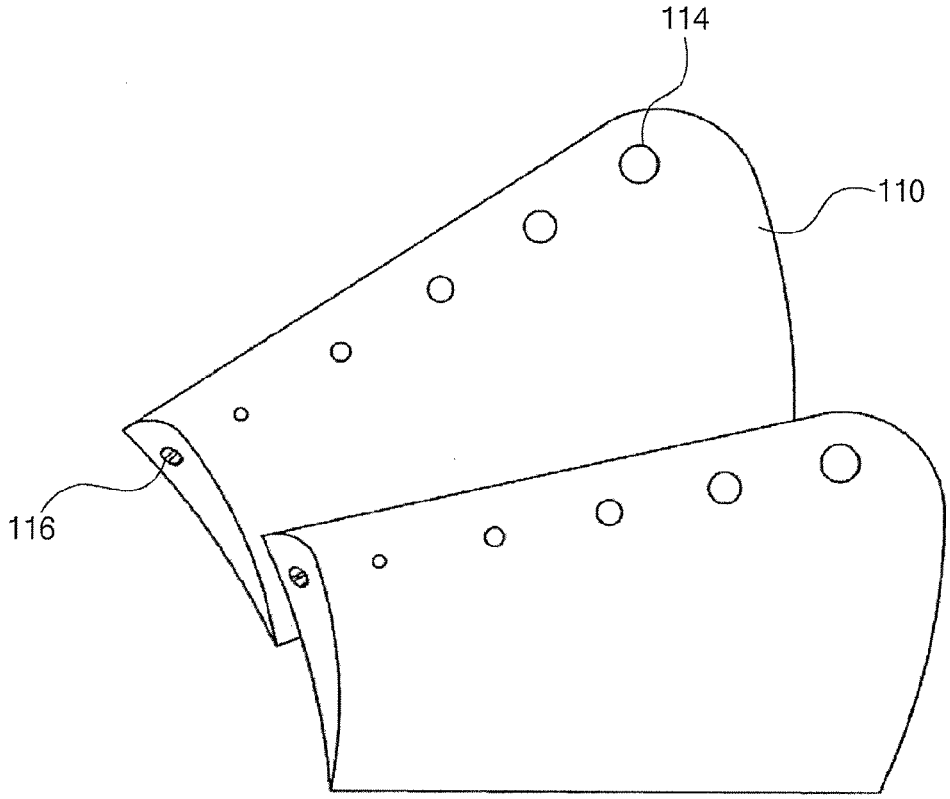
FIG. 3 illustrates a partial perspective view of swirling wings shown in FIG. 2.
Figure 4:
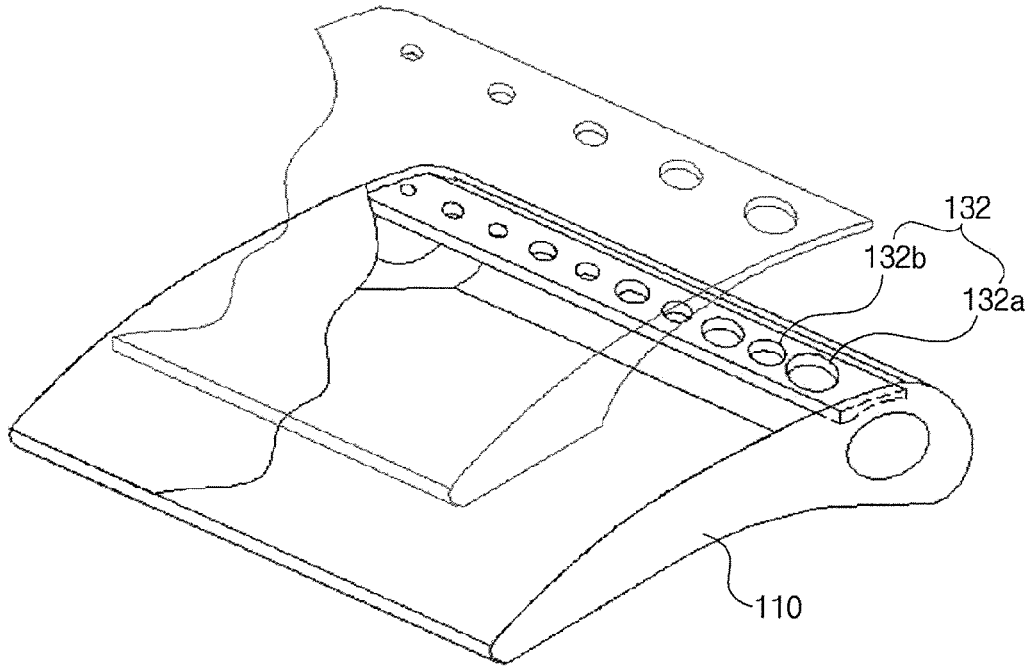
FIG. 4 illustrates an exploded perspective view of the swirling wings shown in FIG. 3.

Hereinafter, an embodiment of the present invention will be described with reference to the accompanying drawings.

As shown in FIGS. 1 to 4, a variable dual fuel nozzle 10 includes swirling wings 110, a central shaft 120, a switching plate 130, a driving unit 140 and a casing 160.

That is, a plurality of swirling wings 110 is disposed along an outer peripheral surface of an upper portion of the central shaft 120. Then, a plurality of main fuel injection holes 122 and a pilot fuel injection hole 124 are disposed at a lower end of the central shaft 120 to pass through a central portion of the central shaft 120 from a lower portion to an upper portion. A plurality of pilot fuel jetting holes 126 is formed at an upper portion of the central shaft 120 to be connected to the pilot fuel injection hole 124. The main fuel injection holes 122 and the swirling wings 110 are connected to each other using a fuel channel 116. In this case, preferably, the main fuel injection holes 122 are formed to have the same number as the number of the swirling wings 110. Further, the pilot fuel jetting holes 126 are formed along an outer periphery of the central shaft 120 to uniformly jet the pilot fuel.

Further, a number of main fuel injection holes 114 are formed on the swirling wings 110. The main fuel injection holes 114 are formed to have a smaller diameter as it goes toward the central shaft 120. Accordingly, it is possible to perform a uniform mixing in relation to the pilot fuel jetted from the central shaft 120.

Further, the switching plate 130 is disposed at a lower portion of the swirling wings 110. The driving unit 140 is disposed to be connected to the switching plate 130, thereby allowing the driving unit 140 to vary a position of the switching plate 130. That is, when a spur gear 144 can be driven by a motor and a rack gear 142 connected to the spur gear 144 can horizontally move, a wire 146 connected at one side of the rack gear 142 moves the switching plate 130. In this case, the wire 146 is moved while being supported by a roller 145.

On the other hand, a number of switching holes 132 are formed on the switching plate 130. The switching holes 132 can have a variable diameter of the main fuel jetting holes 114 when the main fuel is jetted in relation to the main fuel jetting holes 114. Accordingly, the main fuel supplied through the main fuel injection holes 122 can be selected variously according to the use conditions of the main fuel. Any one selected from a group consisting of a natural gas, DME (dimethyl ether, $CH_3OCH_3$), a coal gas and a synthetic gas may be supplied as the main fuel.

Further, the switching holes 132 are formed to include first switching holes 132*a* and second switching holes 132*b*. The diameters of the first switching holes 132*a* and the second switching holes 132*b* are formed differently from each other. The first switching holes 132*a* and the second switching holes 132*b* can have different opening diameters of the main fuel jetting holes 114 according to the kinds of the selected main fuel.

Figure 5A:
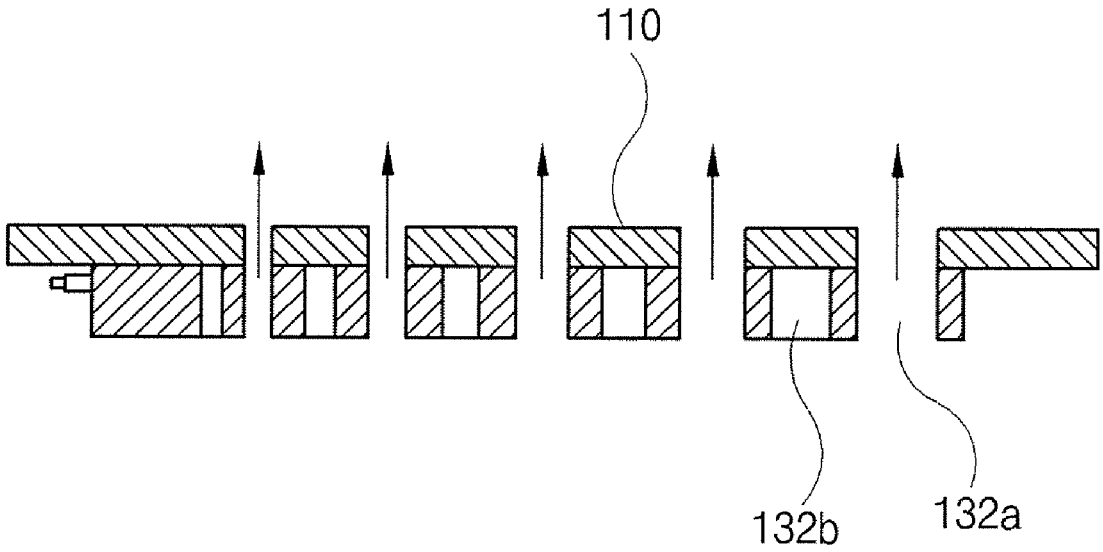
FIGS. 5A and 5B illustrate schematic diagrams showing an operation state of a switching plate.
Figure 5B:
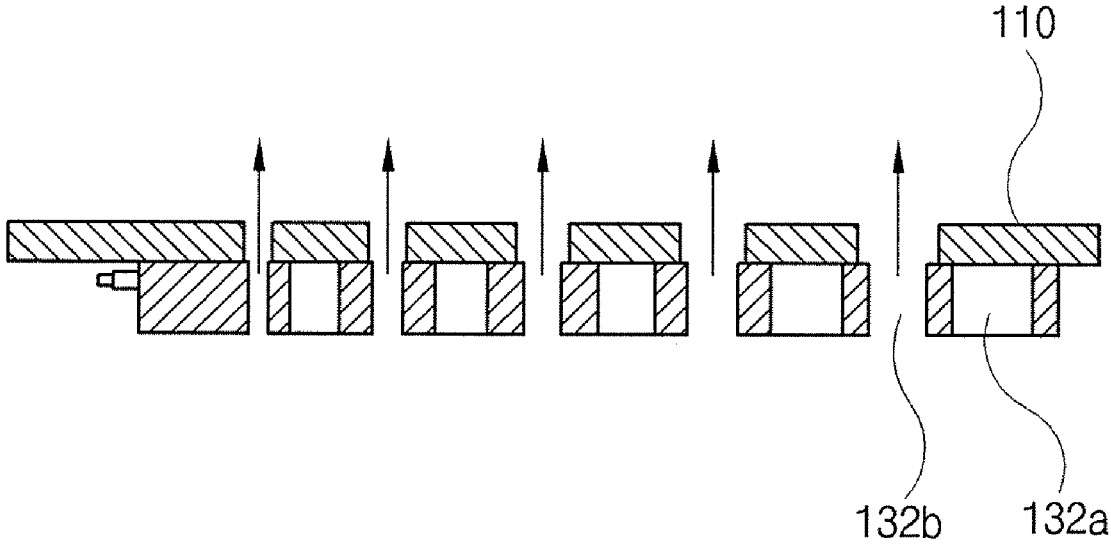

That is, as shown in FIG. 5A or 5B, the opening diameters of the main fuel jetting holes 114 are varied by the first switching holes 132*a* and the second switching holes 132*b* according to a variable position of the switching plate 130.

Further, air is sucked through an air duct 112 by the rotation of the swirling wings 110. The fuel jetted from the pilot fuel jetting holes 126 and the main fuel jetting holes 114 is mixed with air supplied according to the rotation of the swirling wings 110 to be jetted into a combustion chamber.

Figure 6:
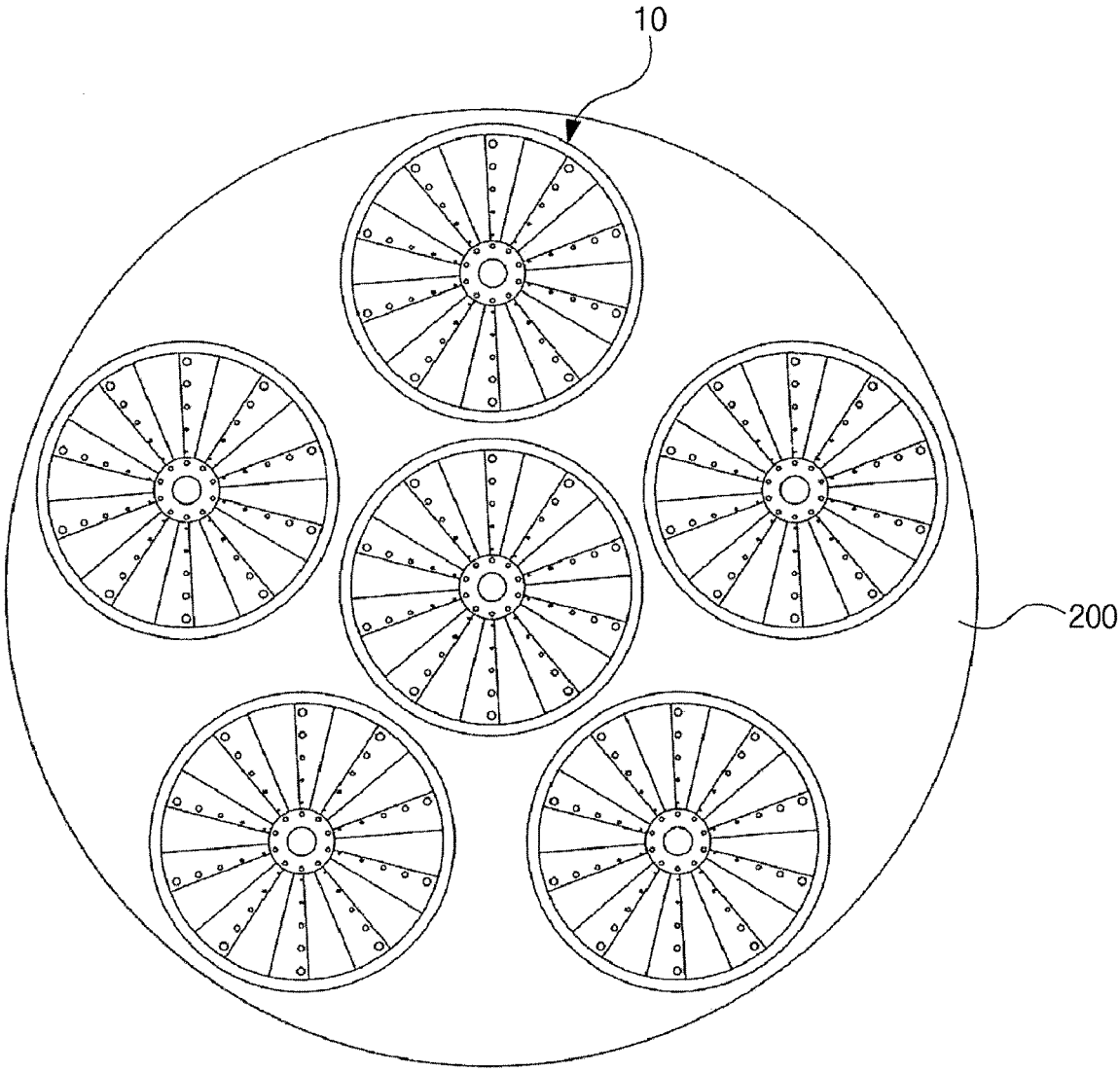
FIG. 6 illustrates a plan view of a variable dual fuel nozzle according to another embodiment of the present invention.

Referring to FIG. 6, according to another embodiment of the present invention, a plurality of variable dual fuel nozzles 10 is disposed and regularly arranged on a liner 200. That is, the variable dual fuel nozzles are configured by a casing and completed by coupling the casing to the liner.

According to the present invention, there is an effect of enhancing fuel flexibility in a multiple fuel system for applying two or more fuels to a gas turbine at the same time.

Further, when a fuel is switched in the gas turbine for dual fuel of a natural gas and DME, a fuel switching can be easily made only by performing a button manipulation. Accordingly, it is possible to contribute an increase of fuel flexibility and omit a decomposition operation of the gas turbine for replacement of the combustor. Thus, there is an effect of reducing labor costs and providing a large economic gain due to the reduction of stop time of the gas turbine.

Further, the fuel jetting hole designed corresponding to the combustion characteristics improves combustion efficiency and reduces combustion instability while reducing a noxious exhaust gas. Also, it is possible to prevent a backfire of the flame, thereby preventing heat burning out of high-temperature channel parts in the gas turbine.

Further, according to the present invention, the invention is applied to a multi-cup combustor with a number of combustion nozzles and a proper fuel jetting flow rate is set for each cup combustor. Accordingly, in a low nitrogen oxide gas turbine combustor for power generation using a lean premixed combustion method, there are effects of stabilizing a whole flame in the combustor, preventing damage of gas turbine parts by preventing a backfire and reducing combustion vibration, and extending a life.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A variable dual fuel nozzle apparatus, comprising:

a duct having one side for introducing a gas and the other side for discharging the gas;

a plurality of swirling members which are arranged at the other side of the duct in a radial shape with respect to a center of the duct and include a first jetting member;

wherein the first jetting member includes a plurality of first jetting holes for jetting a first fuel;

a switching member which is installed inside at least one of the swirling members and includes first holes and second holes corresponding to the first jetting holes; and a driving unit connected to one end of the switching member via a wire to pull the switching member towards a radially inward direction, wherein the driving unit includes;

a rack gear connected to an opposite end of the wire to apply tension to the wire along with movement; and a spur gear coupled to the rack gear to move the rack gear by rotation, wherein positions of the first holes and second holes of the switching member move, and opening diameters of the plurality of first jetting holes vary by movement of the first holes and second holes of the switching member, when the switching member moves radially inward via the wire, by the driving unit.

2. The variable dual fuel nozzle apparatus according to claim 1, wherein the first holes and the second holes are alternately arranged.

3. The variable dual fuel nozzle apparatus according to claim 1, wherein the first holes and the second holes have gradually increasing sizes and a minimum size of the first holes is different from a minimum size of the second holes.

4. The variable dual fuel nozzle apparatus according to claim 1, wherein the switching member moves in a direction parallel to an arrangement direction of the first holes and the second holes.

5. The variable dual fuel nozzle apparatus according to claim 1, wherein the variable dual fuel nozzle apparatus is disposed parallel to a flowing direction of the gas and further includes a second jetting member which jets a second fuel.

6. The variable dual fuel nozzle apparatus according to claim 5, wherein the first holes and the second holes are arranged from the center of the duct toward an edge of the duct, and the first holes and the second holes have gradually increasing sizes from the center of the duct toward the edge of the duct, respectively.

7. The variable dual fuel nozzle apparatus according to claim 5, wherein the second jetting member is formed radially inwardly of the first jetting member and has second jetting holes which jet the second fuel in a direction equal to a jetting direction of the first jetting member, and the second jetting holes include a central jetting hole arranged on a central shaft of the second jetting member and a plurality of outer jetting holes arranged around the central jetting hole.

8. The variable dual fuel nozzle apparatus according to claim 1, wherein the first fuel is any one of DME (dimethyl ether, $CH_3OCH_3$), a coal gas and a synthetic gas.

9. A multi nozzle system, comprising:

a liner; and a plurality of variable dual fuel nozzle apparatuses arranged along a center of the liner and a periphery of the liner, wherein each of the variable dual fuel nozzle apparatuses includes:

a duct having a gas introduction hole formed at one side of the duct to introduce a gas and the other side for discharging the gas;

a plurality of swirling members which are arranged at the other side of the duct in a radial shape with respect to a center of the duct and include a plurality of first jetting holes which jet a first fuel;

a jetting member which is disposed at the center of the duct parallel to a flowing direction of the gas to jet a second fuel and includes a first supply line connected to the swirling members to supply the first fuel to the swirling members;

a switching member which is installed inside at least one of the swirling members and includes first holes and second holes corresponding to the first jetting holes; and a driving unit connected to one end of the switching member via a wire to pull the switching member towards a radially inward direction;

wherein the driving unit includes:

a rack gear connected to an opposite end of the wire to apply tension to the wire along with movement; and a spur gear coupled to the rack gear to move the rack gear by rotation, wherein positions of the first holes and second holes of the switching member move, and opening diameters of the plurality of first jetting holes vary by movement of the first holes and second holes of the switching member, when the switching member moves radially inward via the wire, by the driving unit.

* * * * *